United States Patent [19]

Kaplan

[11] 4,136,876

[45] Jan. 30, 1979

[54] VARIABLE NUMERICAL SELECTION APPARATUS

[76] Inventor: Albert Kaplan, Aesch, Block E, CH-8834 Schindellegi, Switzerland

[21] Appl. No.: 767,534

[22] Filed: Feb. 10, 1977

[30] Foreign Application Priority Data

Jun. 30, 1976 [DE] Fed. Rep. of Germany ..... 2629343

[51] Int. Cl.[2] ..... A63F 7/04

[52] U.S. Cl. ..... 273/138 R; 40/334; 401/195

[58] Field of Search ..... 273/138 R, 138 A, 144 B, 273/144 R, 144 A; 401/52, 195; 40/334

[56] References Cited

U.S. PATENT DOCUMENTS

| | | | |
|---|---|---|---|
| 526,946 | 10/1894 | Schleininger et al. | 273/144 B |
| 1,613,575 | 1/1927 | Brewer | 273/144 B UX |
| 2,799,506 | 7/1957 | Nord | 273/144 B |

FOREIGN PATENT DOCUMENTS

| | | | |
|---|---|---|---|
| 1475188 | 2/1967 | France | 273/138 R |
| 722014 | 1/1955 | United Kingdom | 273/144 B |
| 884838 | 12/1961 | United Kingdom | 273/138 R |
| 933662 | 8/1963 | United Kingdom | 273/144 B |

*Primary Examiner*—William H. Grieb
*Assistant Examiner*—Arnold W. Kramer
*Attorney, Agent, or Firm*—John A. Young

[57] ABSTRACT

A numerical selection apparatus is combined with a ball point pen and is constructed to make numerical combinations from a predetermined number of figures, such combinations being arbitrary and randomly occurrent so as to be useable in such games as "LOTTO" and the like, where chance is a factor in the outcome and play of the game.

11 Claims, 7 Drawing Figures

2

VII
VI
1
2
3
4
5
6
7
8
9
10
11
12

VARIABLE NUMERICAL SELECTION APPARATUS

This invention relates to a numerical selection apparatus combined with ball point pen for the arbitrary and random choice of numerical combinations from a predetermined number of figures in particular for use in the game of lotto or other games.

According to the prior art no numerical selection implement is known by which with a single throw 6 twice (numerical combinations) in number lotto are to be read at once. This is effected according to the present invention in that a transparent casing made of plastics is connected to a ball-pen in which are located two series of 6 small balls which are insertable in holes which are made in both sides of the casing. Associated with the holes are numbers for example, 1–40 on one side and 1–32 on the other side.

With this arrangement it is, for example, possible to select a tip number in the numbers lottery of 6 from 40 as well as the sports tip 6 from 32.

At the same time by means of the arrangement of numbers an increased winning chance due to the frequency number effect is given.

This invention is particularly useful in that it is combined with a ball-pen. Brought about by a shaking movement, 6 balls roll at once each into a respective one of the number marked holes and for a movement now all 6 numbers must remain until recorded in the memory because by the writing movement the individual balls slide down and thus render impossible the partial reading of the numbers.

This manipulation of the lotto recorders promotes and strengthens the memory concentration. On one side of the lotto receiver (see FIG. 1 side view) the lucky throw is to be carried out according to the previous number lotto 6 from 40 whilst on the other side the newly introduced football lotto 6 from 32 can be tipped. That part of the lotto recorder in which are located 6 balls each and 40 and 32 holes each is made of a transparent plastic material.

A further embodiment of the present invention has compared with the hitherto known embodiment, the essential advantages that the given number of figures from which a combination of numbers is to be selected with the aid of balls previously selectable and adjustable.

This is solved in that in a casing a slide moveable in the longitudinal axis of the casing is arranged which has holes so that a certain number is associated with each hole and that balls roll freely moveable on the slide and are capable of being brought into the holes. Thus it is possible that on the slide, playing squares are separable by partial withdrawal of the slide from the casing.

If the slide is pushed completely into the casing then the balls are placed on all holes which are found in the slide. If the slide however is withdrawn then only a certain number of holes are available.

For example, it is thus possible with the slide pushed completely into the casing to select the number combination 6 from 49. By removal of the slide either a marking is made on the slide in order to mark the correct withdrawing or a catch device in order to fulfil the same object, it is then possible to reduce the number of selectable figures.

It is then, for example, possible to effect the number tip to 6 from 39. A further drawing out of the slide reduces the selectable number of figures still further so that it is then, for example, possible to select the number tip 6 from 32.

The playing squares may be separated from one another by line markings which are applied to the slide. The correct playing square is then seperated when the slide is drawn out so far that the line marking cuts off with any desired casing edge preferably however with the rearmost casing edge. Another embodiment of the present invention provides that for the choice of the playing squares a catch device is provided between the casing and the slide capable of being drawn out. Such a catch device may, for example, be effected, by means of resilient ball which engages in a corresponding catch recess on the opposite part. The correct choice of playing square is thereby very much facilitated since owing to the catch connection intermediate positions are immediately distinguishable from the correctly selected positions.

It is also essential that the balls are secured from falling out of the casing, at one end by a stop which is connected to the slide and at the other end by a stop which is connected to the casing. In this way it is ensured that even upon drawing out the slide no balls can fall out of the casing.

On the side of the ball-pen the slide has a stop which prevents the balls in the casing from falling in the direction to the ball pen point. On the opposite end the casing has a stop which closes tightly with the surface of the slide so that the balls with the drawing out of the slide are prevented from being lost from the interior of the casing.

It is also essential that the casing is covered by at least one transparent cover disc on the upper side which runs approximately parallel to the plane of the slide. In this way a satisfactory visibility of the slide and the holes arranged thereon and associated numbers is ensured.

Another embodiment of the invention could also provide for the side walls and/or the floor of the casing to be transparent. Any desired materials can be used.

Especially advantageous is the relatively large surface of the numerical selection apparatus which at the same time can be used as a writing implement so that any desired advertising text and other notices are capable of being applied. Because of the extraordinarily low manufacturing price the numerical selection apparatus according to the invention is suitable as an advertising gift and as a rapidly marketable article made in bulk.

Another embodiment of the present invention provides for the floor of the casing and the upper side of the casing to be transparent and numbers are selectable on the front side and rear side of the slide with the aid of balls.

According to this embodiment it is therefore arranged for the slide to be usable from the front side as well as also from the rear side. Especially advantageous is the fact that the holes inside the slide are formed as recesses and that on the upper side and lower side of the slide a number of recesses differing from one another is provided. In this way it is possible to arrange a plurality of number combinations from a plurality of numbers available at the same time on the slide. On the upper side of the slide, for example, the numbers 1–9 can be applied in the form of recesses whilst on the rear side of the slide the numbers 1–32 are applied. These numbers may then be subdivided respectively again by drawing out the slide to any desired or preselected position. Thus there results a plurality of selection possibilities so that the number selection apparatus according to the invention is usable universally. It is of course also provided for the slide itself to be exchangeable in order to be able to adapt the numerical selection system to different number selection betting in different countries.

For increasing the universal employability of the number selection apparatus according to the invention it is furthermore provided for the number of balls available to be variable as desired. For the choice of a combination, for example 6 from 49 therefore 6 balls are necessary. If from a number of figures a combination with 5 figures be selected then it is arranged according to the present invention, for example, with altogether 6 balls present one ball is closable in a compartment of the housing of the numerical selection apparatus so that now only 5 balls are available. This compartment can be opened and closed as desired so that if required then again 6 balls are available.

It is however also possible to prepare a much greater number of balls in order to do justice to the most varied demands of different numerical selection systems.

Figures 1, 2, 3:
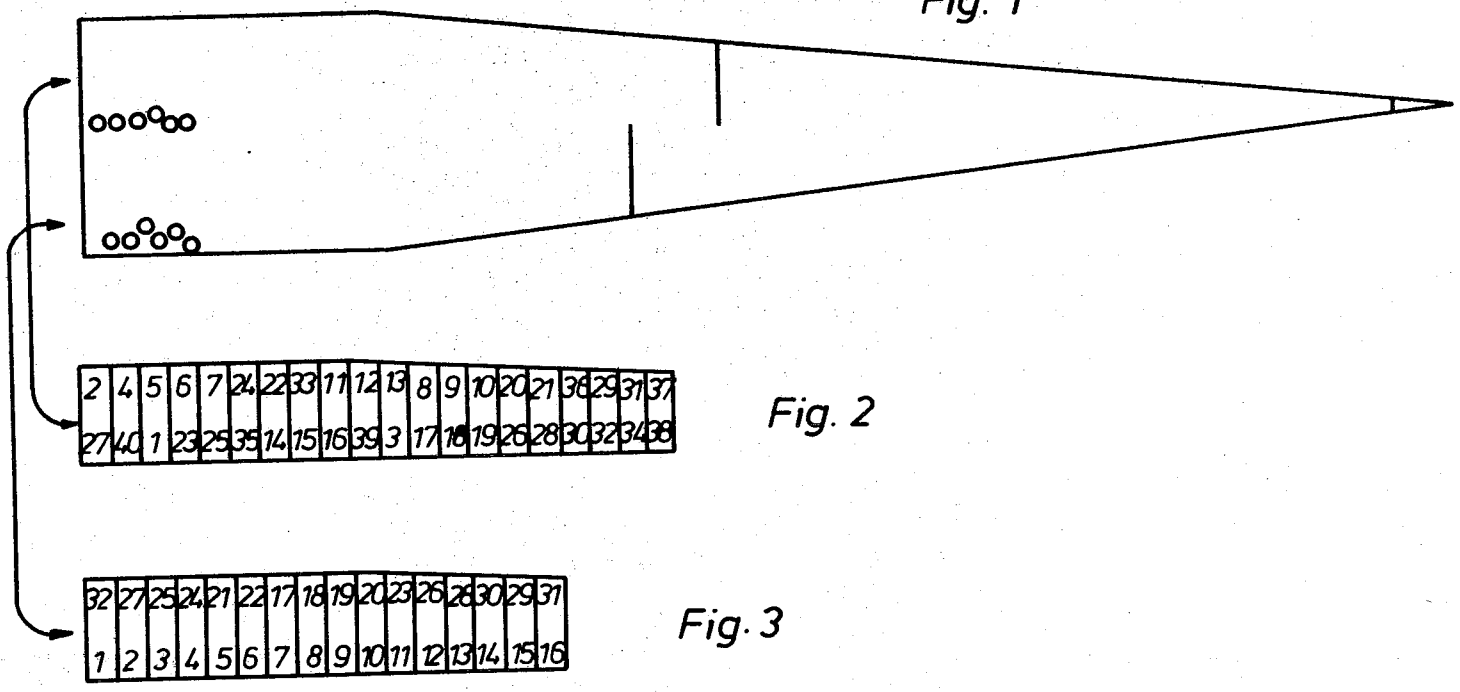
FIG. 1 is a diagrammatic plan of a numerical selection of a first embodiment.
FIG. 2 show a representation of a number panel with a random selected number sequence.
FIG. 3 is another embodiment of a number panel with a similar random selected number sequence.

FIGS. 1–3 show a first embodiment of the present invention in which a transparent plastic casing is fixed at the end of a ball-pen in which are located two series of 6 balls which are capable of being brought into a number of holes in which numbers of, for example, 1–40 pressed onto the holes are associated with one side and 1–32 with the other side. FIGS. 2 and 3 show different possible number panels which are numbered successively corresponding to a chance numerical series.

Figures 4, 5, 6, 7:
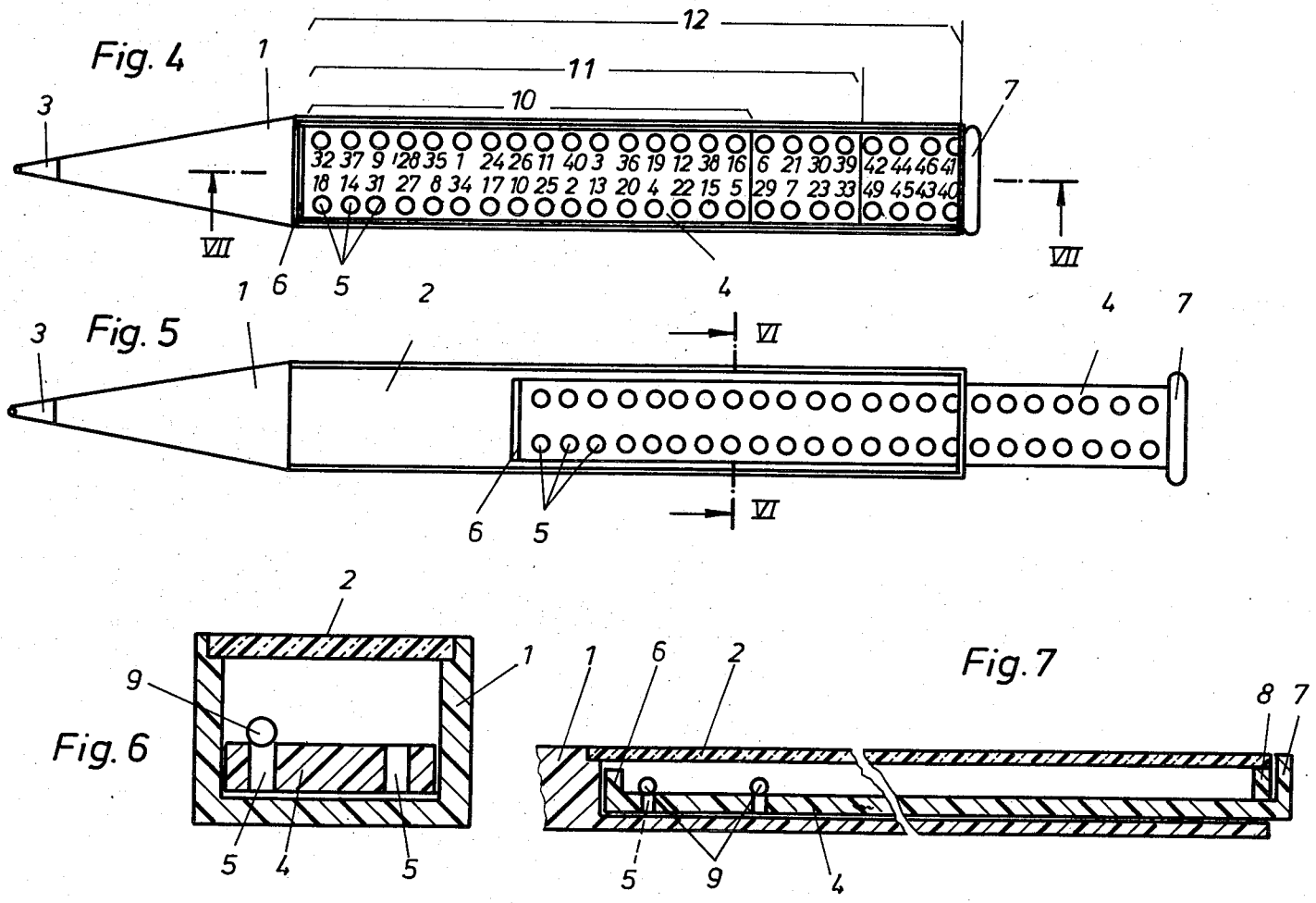
FIG. 4 is a plan view of a second embodiment of a numerical selection apparatus with a slide pushed completely into the casing.
FIG. 5 is a view similar to FIG. 4 with the slide partly drawn out from the casing.
FIG. 6 is a section on the line VI—VI of FIG. 5.
FIG. 7 is a section on the line VII—VII of FIG. 4.

The second embodiment shown in FIGS. 4–7 has the essential advantage that the total number of figures available is variable as desired. The number selection apparatus shown consists of a casing 1 which contains at its front end a ball-pen point 3. Inside the casing 1 a slide 4 is longitudinally moveable in the direction of its longitudinal axis. FIG. 5 shows the slide 4 partially drawn out from the casing 1 and FIG. 6 shows the section through the casing and through the slide 4. Holes 5 are disposed in the slide 4 and a certain number is associated with each hole 5.

Furthermore there are located on the slide (see FIG. 6 and FIG. 7) balls 9 rolling freely on the slide and being capable of being brought into the holes 5.

So that the balls 9 do not fall out of the casing the slide 4 has on its front end a slop 6 (see FIGS. 4,5,7) and the casing has at its opposite end a stop 8 which lies with its limiting edge closely above the upper face of the slide 4 (see FIG. 7) so that during the drawing out of the slide 4 balls 9 are also prevented from being drawn out of the casing 1.

In this way it is ensured that the balls 9 always remain in the casing.

It is furthermore essential for the casing 1 to be covered by at least one transparent cover 2 on the upper side (see FIG. 6 and FIG. 7) which runs approximately parallel to the plane of the slide 4. In this way a satisfactory viewing of the members pressed out the slide is ensured.

In the embodiment of FIG. 4 the individual successive holes 5 of the slide are numbered according to the chance numerical series. It is however likewise possible to number the successive holes in increasing numbers. Essential with the embodiment according to the invention is that on the slide 4 playing panels 10,11,12 (see FIG. 4) are separable by partial drawing out of the slide 4 from the housing 1 (see FIG. 5). In the embodiment of FIG. 4, for example, 6 balls are freely moveable on the slide 4 inside the casing 1 and capable of being brought into the holes 5.

With the numbering shown in FIG. 4 it is then possible to carry out the selection 6 from 49 with the 6 balls present as altogether in the pushed in position of the slide (see FIG. 4) 49 holes are available for the balls 9. By drawing out the slide 4 (see FIG. 5) the number of holes for the balls 9 remaining inside the casing 1 is reduced. In the position of the slide as shown in FIG. 5 the number tip 6 could then, for example, be met from 39. The individual playing panels may be separated from one another by line markings as shown, for example, in FIG. 4. Another embodiment of the present invention provides for the choice of the playing panels 10,11,12 for a catch to be provided between the casing 1 and the slide 4 capable of being drawn out.

A further preferred embodiment of the present invention provides for the side walls and/or the bottom of the casing to be transparent. Altogether if the side walls are transparent a still improved visibility of the balls 9 inside the casing 1 can thus be effected.

In so far as the bottom is also formed transparent it is preferred if on the front and rear side of the slide 4 different numbers are selected with the aid of balls 9.

Especially advantageous is when the holes 5 inside the slide 4 are formed as recesses and that on the upper end lower side of the slide a number of recesses different from one another is provided. On the upper side there may be present, for example, 6 balls which are associated with an available number of 49 recesses. On the rear side of the slide there may then be, for example, 5 balls, which, for example, are associated with an available number of 32 recesses.

The number of available holes 5 is reducible by selectively drawing out the slide 4 in order to reduce the number of available locations for the balls 9. This changes the permutations and element of chance by reducing the total number of available recesses in relation to the number of balls. This is what varies the available permutations.

The above mentioned embodiment have had a fixed given numbers of balls 9 provided inside the casing 1. Another embodiment of the present invention could however provide for one or several of the balls 9 to be capable of being brought into a compartment of the casing to be opened and closed.

Thus it is possible that of, for example, altogether 6 available balls one ball can be enclosed in the compartment provided in the casing 1 so that now only 5 balls 9 are available.

With these 5 balls, for example, then the selection bet from 39 can be met.

Due to the exchangeability of the slide and due to the choice as desired of the available number a universal employability of the base number selection is ensured.

The base number selection may therefore be used according to the invention for all known numerical selection bets with which it concerns selecting from a certain predetermined number of figures a certain combination of numbers.

Although the present invention has been illustrated and described with reference to a few selected example embodiments, it will be understood that these are illustrative of the invention and are by no means restrictive thereof. It is reasonably to be expected that those skilled in this art can make numerous revisions and adaptations of the invention, and it is intended that such revisions and adaptations will be included within the scope of the following claims as equivalents of the invention.

What I claim is:

1. A numerical selection apparatus comprising a casing, means forming an interior chamber of said casing, and including an opening for viewing the interior of said chamber, a transparent covering for said opening, a slide longitudinally movable relatively to said casing, means exterior to said casing for effecting longitudinal displacement of said slide to a preferred position means forming a guide opening by which said slide is movable relative to said casing through the guidance opening of said casing, a plurality of locating means on said slide, each having a numerical assigned value and adapted for games of chance, and a plurality of surface projectiles which are randomly positionable within said chamber and on said locating means after said slide has been moved to a preselected position to select the ratio of locating means to said surface projectiles.

2. The numerical selection apparatus in accordance with claim 1 wherein said locating means are in the form of holes which are formed in said slide.

3. The numerical selection apparatus in accordance with claim 2 in which said slide is proportioned in relation to said casing to provide a free-rolling area, and said surface projectiles are balls which are permitted to roll over the surface of said slide until entering one of said holes.

4. The numerical selection apparatus according to claim 3, characterized in that the apparatus is additionally in the form of a ball point pen.

5. The numerical selection apparatus in accordance with claim 1 including means forming stops on the surface of said slide defined by an abutment at one end of said slide and by an abutment of said casing which confines rolling action of the surface projectiles to a prescribed playing area of said slide.

6. The numerical selection apparatus in accordance with claim 1 wherein said transparent cover for said slide is disposed in a plane substantially parallel to the plane of said slide.

7. The numerical selection apparatus in accordance with claim 6 wherein said casing includes transparent side walls and bottom whereby the interior of said chamber is viewable from each of the casing sides.

8. The numerical selection apparatus in accordance with claim 7 in which the locating means in said slide are numbered in accordance with a pattern corresponding to a chance number series.

9. The numerical selection apparatus in accordance with claim 8 characterized in that a portion of the slide includes separable playing panels positionable responsively to slideable withdrawing movement of said slide within said casing.

10. The numerical selection apparatus in accordance with claim 9 in which said panels are exchangeable one with the other.

11. The numerical selection apparatus in accordance with claim 9, characterized in that the playing areas of respective panels are separated from one another by line markings.

* * * * *